US007997709B2

(12) United States Patent
Baumer et al.

(10) Patent No.: US 7,997,709 B2
(45) Date of Patent: Aug. 16, 2011

(54) DROP ON DEMAND PRINT HEAD WITH FLUID STAGNATION POINT AT NOZZLE OPENING

(75) Inventors: Michael F. Baumer, Dayton, OH (US); Michael J. Piatt, Dayton, OH (US); Yonglin Xie, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 478 days.

(21) Appl. No.: 11/425,309

(22) Filed: Jun. 20, 2006

(65) Prior Publication Data

US 2007/0291082 A1 Dec. 20, 2007

(51) Int. Cl.
*B41J 2/18* (2006.01)
*B41J 2/045* (2006.01)
*B41J 2/175* (2006.01)

(52) U.S. Cl. ..... 347/89; 347/68; 347/85

(58) Field of Classification Search ..... 347/65, 347/94, 68, 84, 85, 89, 92, 70
See application file for complete search history.

(56) References Cited

U.S. PATENT DOCUMENTS

| | | | | |
|---|---|---|---|---|
| 4,184,169 | A | 1/1980 | Taylor et al. | |
| 4,345,259 | A | 8/1982 | Reitberger | |
| 4,432,003 | A | 2/1984 | Barbero et al. | |
| 4,536,776 | A * | 8/1985 | Knirsch et al. | 347/55 |
| 4,544,933 | A | 10/1985 | Heinzl | |
| 4,792,818 | A | 12/1988 | Eldridge et al. | |
| 4,870,433 | A | 9/1989 | Campbell et al. | |
| 4,985,710 | A | 1/1991 | Drake et al. | |
| 5,231,426 | A | 7/1993 | Sweet | |
| 5,818,485 | A | 10/1998 | Rezanka | |
| 6,029,518 | A | 2/2000 | Oeftering | |
| 6,039,442 | A * | 3/2000 | Hagiwara et al. | 347/89 |
| 6,126,270 | A | 10/2000 | Lebens et al. | |
| 6,199,970 | B1 | 3/2001 | Roy et al. | |
| 6,244,694 | B1 * | 6/2001 | Weber et al. | 347/65 |
| 6,412,913 | B1 | 7/2002 | Moon et al. | |
| 6,422,690 | B1 | 7/2002 | Harvey et al. | |
| 6,457,813 | B2 | 10/2002 | Silverbrook | |
| 2003/0150931 | A1 * | 8/2003 | Drury et al. | 239/102.1 |
| 2005/0146569 | A1 | 7/2005 | Hoisington et al. | |

FOREIGN PATENT DOCUMENTS

| | | |
|---|---|---|
| EP | 0 465 071 | 1/1992 |
| EP | 1 525 985 | 4/2005 |
| JP | 58-187369 | 11/1983 |
| WO | WO 01/49493 | 7/2001 |

OTHER PUBLICATIONS

IBM Technical Disclosure Bulletin, vol. 31, No. 6, Nov. 1988.

* cited by examiner

*Primary Examiner* — Geoffrey Mruk
(74) *Attorney, Agent, or Firm* — William R. Zimmerli

(57) ABSTRACT

A drop on demand ink jet print head has a chamber with a plurality of liquid passages into and out of said chamber, such that liquid is continuously moved into the chamber to a stagnation point adjacent to the nozzle opening, whereat the fluid comes substantially to rest, and out of the chamber from the stagnation point such that vector sum of liquid flow derived forces within the liquid channels is neutral. An actuator associated with the chamber is adapted to selectively increase the pressure of the liquid at the stagnation point to thereby eject a liquid drop from the nozzle opening. Continuous fluid flow internal to the system decreases the time to refill the fire chamber directly behind the nozzle opening after droplet ejection. This in turn dramatically increases the response time of the system.

21 Claims, 6 Drawing Sheets

DROP ON DEMAND PRINT HEAD WITH FLUID STAGNATION POINT AT NOZZLE OPENING

FIELD OF THE INVENTION

The present invention relates to the field of drop on demand inkjet printers, and more particularly to the improvement in ejection frequency and response time of such drop on demand printing systems.

BACKGROUND OF THE INVENTION

Traditionally, digitally controlled color ink jet printing is accomplished by one of two technologies; "continuous stream" or "drop on demand." In both, liquid, such as ink, is fed through channels formed in a print head. Each channel includes a nozzle from which droplets are selectively extruded and deposited upon a recording surface. Continuous stream printing uses a pressurized liquid source that produces a stream of droplets that are selectively steered toward a recording surface to imagewise deposit thereon, or are captured to be recycled On the other hand, drop on demand printing, provides droplets for impact upon a recording surface. Selective activation of an actuator causes the formation and ejection of a flying droplet that strikes the recording surface. The formation of printed images is achieved by controlling the individual formation of droplets. For example, in a bubble jet printer, liquid in a channel of a print head is heated, creating a bubble that increases internal pressure to eject a droplet from a nozzle opening of the print head. Piezoelectric actuators, such as that disclosed in U.S. Pat. No. 5,224,843, issued to VanLintel, on Jul. 6, 1993, have a piezoelectric crystal actuator in a fluid channel that flexes when an electric current flows through it, forcing a droplet out of a nozzle.

Drop on demand inkjet printing systems have traditionally suffered from a problem of limited droplet ejection frequency. Once a single droplet is ejected form the print head, the ink cavity behind the nozzle opening needs to refill with ink before a second droplet can be ejected. Additionally, the system must dampen the perturbation associated with drop ejection and the system returned to steady state conditions before the next drop can be fired. All of this places constraints onto the fire frequency of drop on demand printing systems and reduces the response time of the system.

By increasing the speed capabilities of drop on demand printing system, it becomes possible to exploit the low manufacturing costs of these systems compared to faster and more expensive counterparts. It is an object of the present invention to increase the speed capabilities of a drop on demand print system by creating continuous flow through in an internal cavity of a drop on demand style print head, and to incorporate a flow stagnation point centered at each nozzle opening in the internal flow path.

SUMMARY OF THE INVENTION

It is possible to reduce this limitation by having a continuous flow of fluid from behind each orifice. Continuous fluid flow internal to the system decreases the time to refill the fire chamber directly behind the nozzle opening after droplet ejection. This in turn dramatically increases the response time of the system.

Accordingly, it is a feature of the present invention to provide a drop on demand ink jet print head having a chamber with a plurality of liquid passages into and out of said chamber, such that liquid is continuously moved into the chamber to a stagnation point adjacent to the nozzle opening, whereat the fluid comes substantially to rest, and out of the chamber from the stagnation point such that vector sum of liquid flow derived forces within the liquid channels is neutral. An actuator associated with the chamber is adapted to selectively increase the pressure of the liquid at the stagnation point to thereby eject a liquid drop from the nozzle opening.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
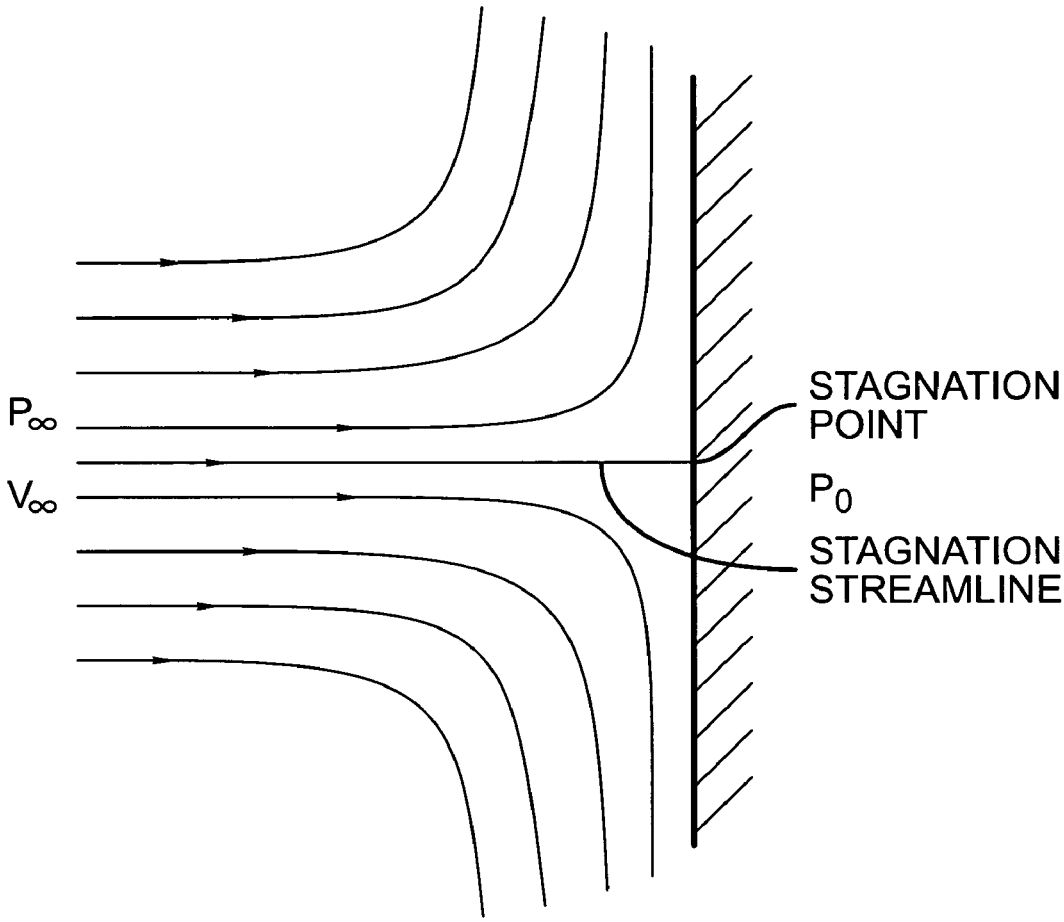
FIG. 1 is an illustration of stagnation point flow.

Bernoulli's equation states:

$$P+\tfrac{1}{2}\rho V^2+\rho g h=\text{constant},$$

where p is pressure, ρ is density, V is velocity, h is elevation, and g is gravitational acceleration. When a steady flow impinges on a perpendicular plate, as shown in FIG. 1, there is one streamline that divides the flow in half. Above this streamline, all the flow goes over the plate, and below this streamline all the flow goes under the plate. Along this dividing streamline, the fluid moves towards the plate. Since the flow cannot pass through the plate, the fluid must come to rest at the point where it meets the plate. In other words, the fluid "stagnates."The fluid along the dividing, or stagnation, streamline slows down and eventually comes to rest without deflection at a "stagnation point."

Bernoulli's equation along the stagnation streamline gives $$p_e+\tfrac{1}{2}\rho V_e^2=p_0+\tfrac{1}{2}\rho V_0^2,$$

where the point e is far upstream and point 0 is the stagnation point. Since the velocity at the stagnation point is zero, $$p_e+\tfrac{1}{2}\rho V_e^2=p_0.$$

The stagnation pressure, $p_0$, is the pressure measured at the point where the fluid comes to rest. It is the highest pressure found anywhere in the flowfield, and it occurs at the stagnation point. It is the sum of the static pressure and the dynamic pressure measured far upstream. The dynamic pressure is so named because it arises from the motion of the fluid. The dynamic pressure is not really a pressure at all. It is simply a convenient name for the quantity (half the density times the velocity squared) which represents the decrease in the pressure due to the velocity of the fluid. We can also express the pressure anywhere in the flow in the form of a non-dimensional pressure coefficient $C_p$, where $$C_p=\frac{p-p_e}{\frac{1}{2}\rho V_e^2}$$

At the stagnation point $C_p$=1, which is its maximum value. In the freestream, far from the plate. $C_p$=0.

Figure 2:
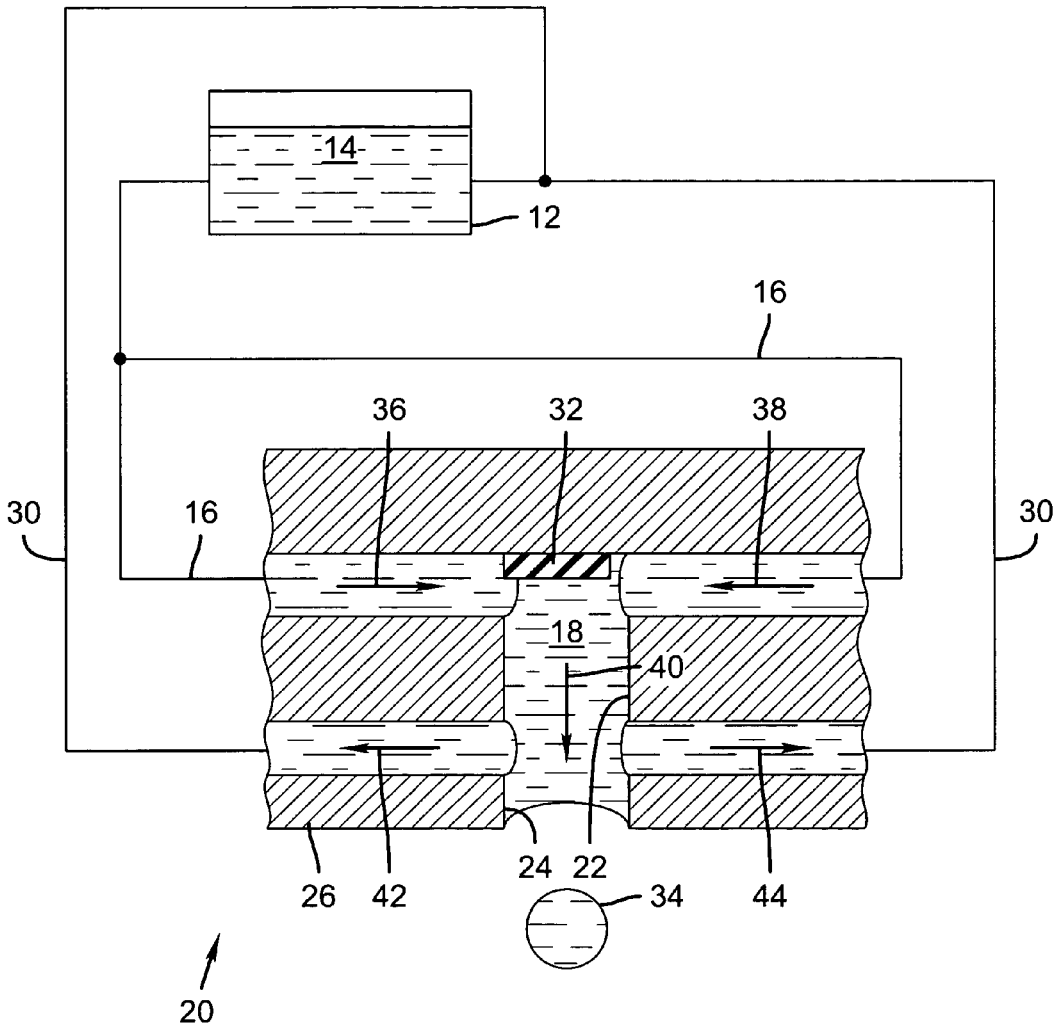
FIG. 2 is a schematic illustration of a drop on demand inkjet printing system according to the present invention.

Referring to FIG. 2, an ink jet apparatus 10 includes a reservoir 12 containing a supply of ink 14 and an ink supply passage 16 leading from the reservoir to a pressure chamber 18 of a print head 20. An internal passage 22 leads to a nozzle opening 24 in a nozzle plate 26. Nozzle plate 26 has an array of nozzle openings like the one nozzle opening 24 illustrated in FIG. 2. The ink forms a meniscus 28 at the ink/air interface at the nozzle opening. The operating pressure in chamber 18 is selected such that weeping from the nozzle opening is not a problem. Pressure control is provided by any suitable means well known in the art. Examples include hydraulic head pressure, hydraulic head pressure with a variable vacuum above the reservoir, hydraulic pump, air pressure alone, etc. An ink return passage 30 is provided so that there is a constant flow of ink from reservoir 12, through supply passage 16, to pressure chamber 18, and back to the reservoir through return passage 30.

An actuator 32, such as a piezoelectric, acoustic, thermal, or electrostatic actuator, inside pressure chamber 18 is operable to force ink from the pressure chamber through passage 22 and out of nozzle opening 24, causing a droplet 34 to be ejected from nozzle opening 24 toward a recording surface (not shown). During operation, one or both of the ink jet apparatus and the recording surface may be moved relative to the other. By selective ejection of droplets from an array of such nozzle openings along the nozzle plate, a desired image is produced on the recording surface.

Fluid enters pressure chamber 18 of print head 20 from passages 16 as shown by directional arrows or flow streamlines 36 and 38. Fluid travels past actuator 32, and turns into passage 22 towards nozzle opening 24 as indicated by directional arrow or stagnation (dividing) streamline 40. Just before passage 22, the flow splits (see directional arrows or flow streamlines 42 and 44) and exits the firing chamber via ink return passages 30. A stagnation point exists on the directional arrow or stagnation (dividing) streamline 40 directly inside nozzle opening 24, preventing air ingestion through the nozzle opening. See FIGS. 1 and 2.

The stagnation point directly inside the nozzle opening allows printing at a higher frequency than the traditional drop on demand devices as a result of the forced refill after droplet ejection. By creating a stagnation point with flow symmetry above the nozzle opening by dual port input and output flow paths, this invention promotes proper jet directionality and improved refill time.

Figure 3:
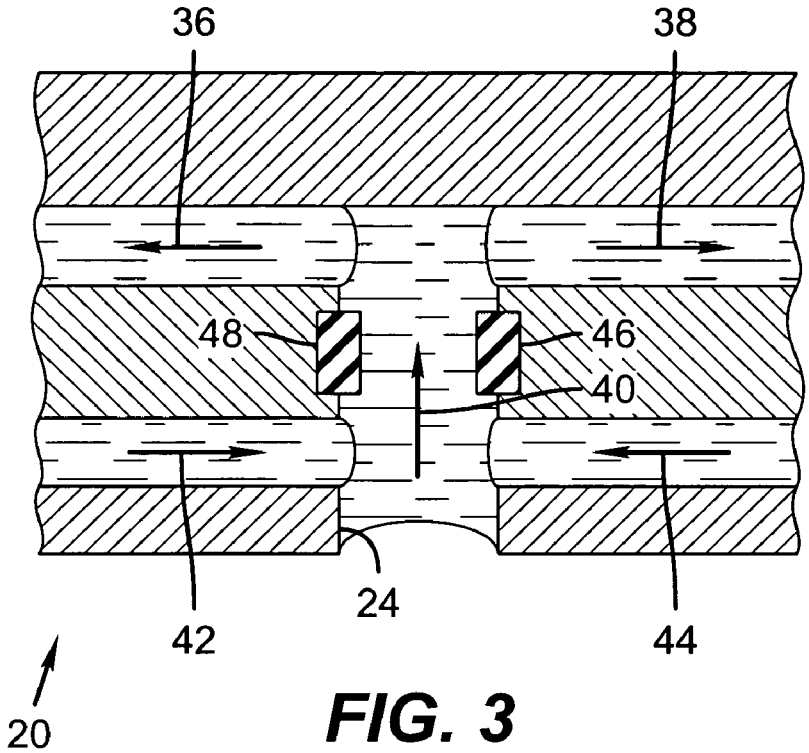
FIGS. 3-7 are schematic views of various embodiments of the print head of FIG. 3.

In ink jet print heads, suitable stagnation flow geometries can result from several formats, such as directing ink toward the nozzle opening perpendicular to the plane of the nozzle opening array as illustrated in FIG. 2, or by reversing all flow directions. That is, although the flow paths through the passages are shown in a specific direction, the flow could be reversed through the passages of print head 20. Either flow direction results in a stagnation point with flow symmetry just above the nozzle opening 24. The opposite flow direction is illustrated in FIG. 3.

The mechanism by which the ejection of the droplet occurs differs upon choice of the energy source. Still referring to FIG. 3, a pair of side wall energy sources 46 and 48 act to eject a droplet from nozzle opening 24 by one of several different mechanisms. If the side wall energy sources 46 and 48 are thermal in nature, then there is a localized pressure drop in the fluid flow above the nozzle opening, which accelerates the flow toward the nozzle opening. The accelerated flow toward the nozzle opening, with the fixed fluid flow directions in the lower passages 42 and 44 effectively raises the pressure at nozzle opening 24 and ejects droplet. It should also be noted that in this embodiment, the thermal energy supplied to the fluid is insufficient to cause the fluid to reach the point of vaporization.

In an alternative embodiment wherein thermal energy sources 46 and 48 are brought to the point of fluid vaporization, the thermal energy serves to decrease the effective area of fluid flow in direction 40, raising the pressure in the cavity just inside nozzle opening 24, and ejecting a droplet.

In yet another alternative embodiment, side wall energy sources 46 and 48 may be piezoelectric (PIT) crystals. In which case, an acoustic energy pulse is sent through the fluid. The pulse is operable to raise the pressure in pressure chamber 18 and creates droplet 34.

Figure 4:
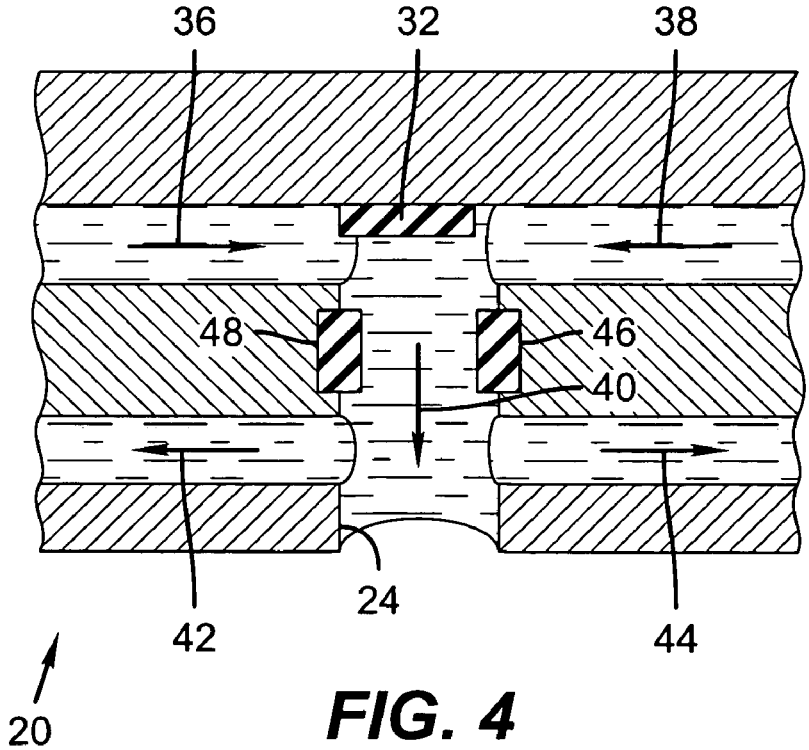
Figure 5:
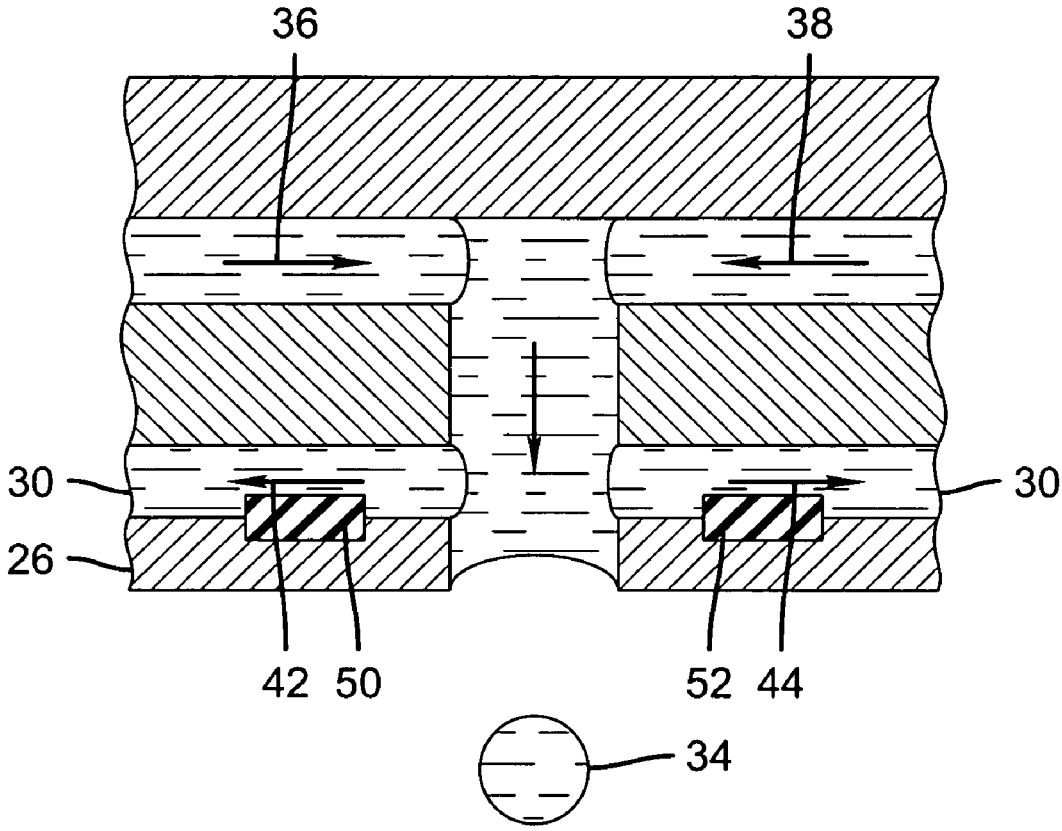

The embodiment shown in FIG. 4 combines an actuator 32 as in FIG. 2 and a pair of actuators 46 and 48 as in FIG. 3. FIG. 5 shows yet another embodiment utilizing a pair of actuators 50 and 52 are mounted on the inner surface of nozzle plate 26 downstream of nozzle opening 24. Actuators 50 and 52 restrict the fluid flow within passages 30 to create an elevated pressure to eject a droplet 34. When actuators 50 and 52 are thermal, it is possible to create a vapor bubble in passages 30 to momentarily restrict the fluid flow path.

Figure 6:
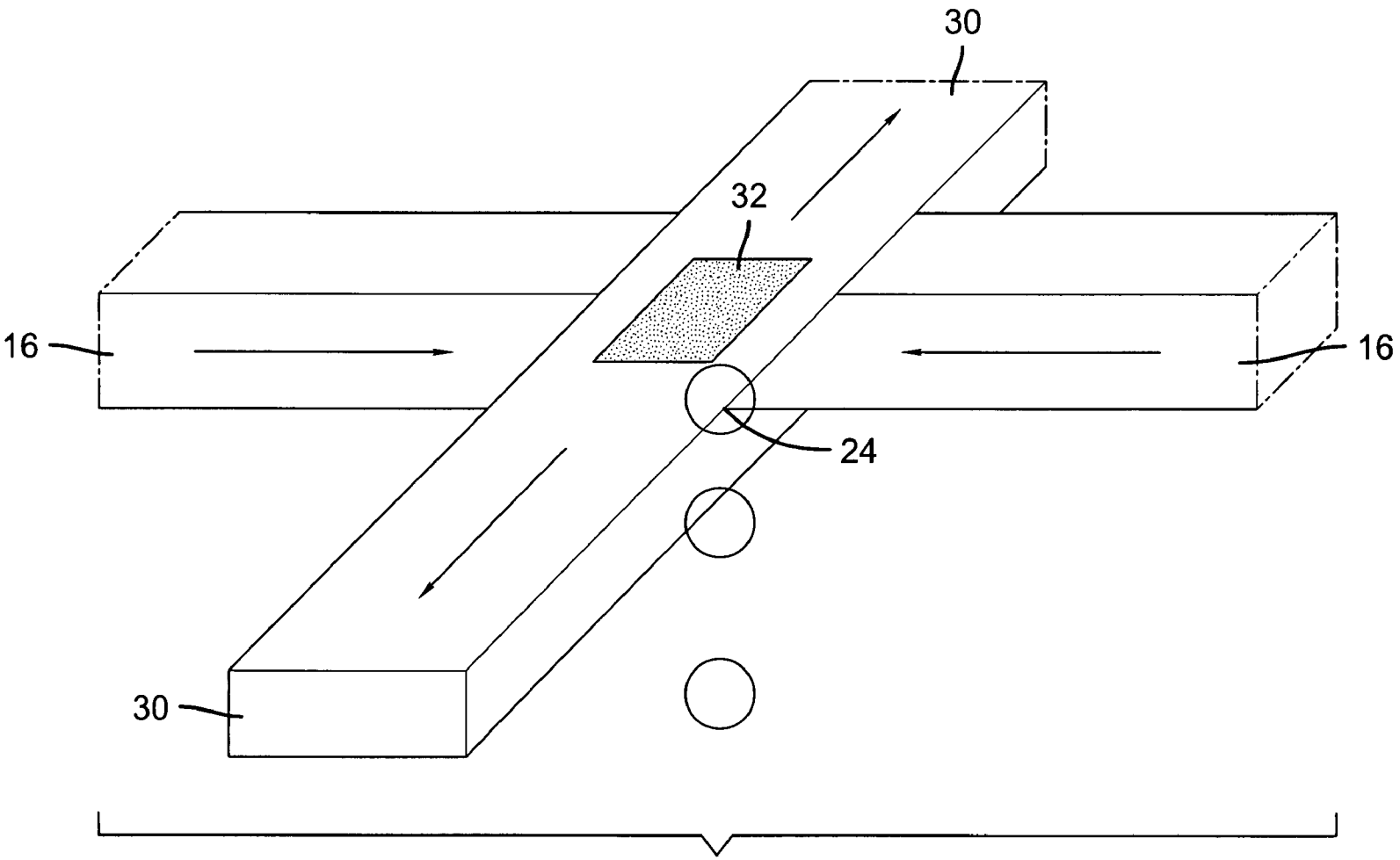
Figure 7:
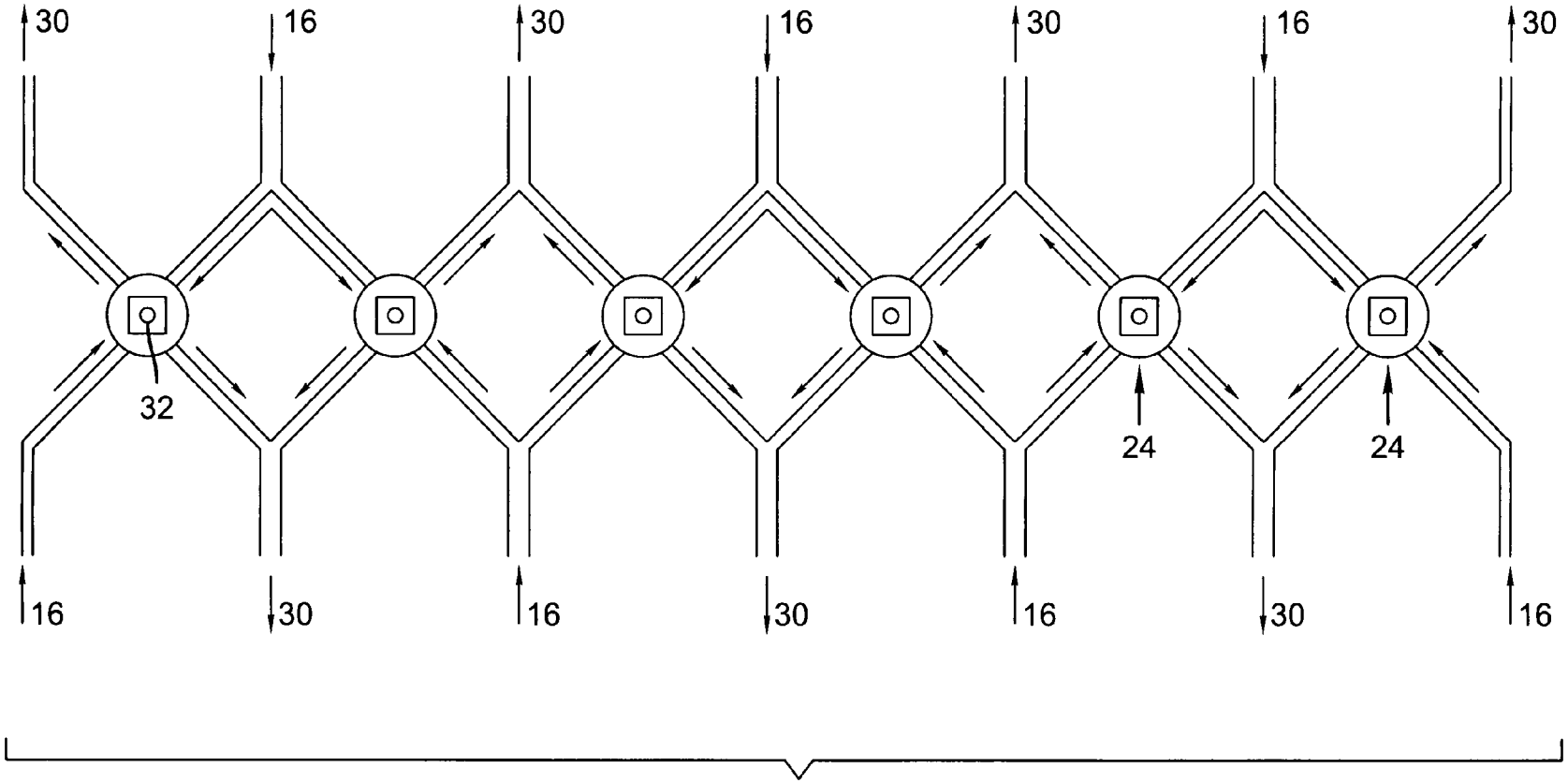

Stagnation flow geometry can be achieved between opposing in flows that are parallel to the plane of the array wherein the fluid meets directly adjacent to the nozzle opening and exits the fire chamber in one or more directions, which are different from the input flow paths. Referring to FIG. 6, all of the flow passages necessary to create a stagnation point are formed in a plane parallel to the nozzle plate. Fluid enters from opposed inlet passages 16 and exits through opposed outlet passages 30. A nozzle opening and an opposed actuator 32 span the junction of passages. FIG. 7 shows an array of passages and nozzle openings as shown in FIG. 6. The array is easily fabricated. It includes planar, interconnected, orthogonal inlet and outlet ports. The common flow inlet ports 16 provide fluid to all nozzle openings24. Common outlet passages 30 remove fluid form each nozzle opening. In the specifically diagrammed embodiment, an actuator 32 is placed above each nozzle opening in the array to eject fluid on demand.

The invention has been described in detail with particular reference to certain preferred embodiments thereof, but it will be understood that variations and modifications can be effected within the spirit and scope of the invention.

PARTS LIST

10 ink jet apparatus
12 reservoir
14 ink supply
16 ink supply passage
18 pressure chamber
20 print head
22 passage
24 nozzle opening
26 nozzle plate
28 meniscus
30 ink return passage
32 actuator
34 ink droplet
36 directional arrow
38 directional arrow
40 directional arrow
42 directional arrow
44 directional arrow
46 energy source
48 energy source
50 actuator
52 actuator

The invention claimed is:

1. A drop on demand ink jet print head comprising:

a nozzle plate defining a wall of a chamber;

a nozzle opening through said nozzle plate from which liquid droplets can selectively be ejected from the chamber;

a plurality of liquid passages into said chamber adapted to continuously move the liquid into the chamber to a stagnation point adjacent to the nozzle opening where the liquid located at the stagnation point comes substantially to rest, the stagnation point being on a stagnation streamline in the chamber which divides liquid flow in half and is directed towards the nozzle opening;

a plurality of liquid passages out of said chamber adapted to continuously move the liquid from the stagnation point such that vector sum of liquid flow derived forces within the liquid channels is neutral; and at least one actuator associated with said chamber for selectively increasing pressure of the liquid at the stagnation point to thereby eject a liquid drop from said nozzle opening.

2. A drop on demand ink jet print head as defined in claim 1 wherein the nozzle plate is planar and the liquid passages are adapted to move liquid into and out of the chamber in a plane parallel to the plane of the nozzle plate.

3. A drop on demand ink jet print head as defined in claim 1 wherein the nozzle plate is planar and the liquid passages are adapted to move liquid through the chamber in a direction orthogonal to the plane of the nozzle plate.

4. A drop on demand ink jet print head as defined in claim 1 further comprising a plurality of nozzle openings with associated chambers and actuators, wherein there is a common liquid passage into the chambers of the plural nozzle openings and a common liquid passage out of the chambers of the plural nozzle openings.

5. A drop on demand ink jet print head as defined in claim 1 wherein fluid pressure at the stagnation point on the stagnation streamline in the chamber is greater than at any other position in the chamber.

6. A drop on demand ink jet print head as defined in claim 1 wherein the actuator is in the liquid passages moving liquid to the stagnation point on the stagnation streamline in the chamber.

7. A drop on demand ink jet print head as defined in claim 1 wherein the actuator is in the chamber and not in the liquid passages moving liquid from the stagnation point on the stagnation streamline in the chamber.

8. A drop on demand ink jet print head as defined in claim 1 wherein the stagnation point on the stagnation streamline in the chamber exists directly inside of the nozzle opening, preventing air ingestion through the nozzle opening.

9. A drop on demand ink jet print head as defined in claim 1 wherein the stagnation point on the stagnation streamline in the chamber is centered at the nozzle opening.

10. A drop on demand ink jet print head as defined in claim 1 wherein there are opposing in flows of the liquid towards one another in respective passages preceding the stagnation point on the stagnation streamline in the chamber.

11. A drop on demand ink jet print head as defined in claim 1 wherein the stagnation point on the stagnation streamline in the chamber is directly adjacent to the nozzle opening.

12. A drop on demand ink jet image forming method comprising the steps of:

operating a print head having a nozzle plate defining a wall of a chamber and a nozzle opening through said nozzle plate;

continuously flowing liquid into the chamber using a plurality of passages, the liquid flowing to a stagnation point adjacent to the nozzle opening where the liquid located at the stagnation point comes substantially to rest, and wherein the stagnation point is on a stagnation streamline in the chamber which divides liquid flow in half and is directed towards the nozzle opening;

continuously flowing liquid out of the chamber using a plurality of passages, the liquid flowing from the stagnation point such that vector sum of liquid flow derived forces within the liquid channels is neutral; and selectively increasing pressure of the liquid at the stagnation point to thereby eject a liquid drop from said nozzle opening.

13. A method as defined in claim 12 wherein the nozzle plate is planar and the liquid is moved into and out of the chamber in a plane parallel to the plane of the nozzle plate.

14. A method as defined in claim 12 wherein the nozzle plate is planar and the liquid is moved into the chamber in a direction orthogonal to the plane of the nozzle plate.

15. A drop on demand print head comprising:

a nozzle plate defining a wall of a chamber;

a nozzle opening through said nozzle plate from which liquid droplets can selectively be ejected from the chamber;

a plurality of liquid passages into said chamber that continuously move liquid into said chamber and a plurality of liquid passages out of said chamber that continuously move liquid out of the chamber, the plurality of liquid passages into said chamber and the plurality of liquid passages out of said chamber being positioned relative to each other such that flow symmetry is present within the chamber, the flow symmetry including a stagnation point inside the nozzle opening; and at least one actuator associated with said chamber for selectively increasing pressure of the liquid at the stagnation point to thereby eject a liquid drop from said nozzle opening.

16. A drop on demand ink jet print head as defined in claim 15, the nozzle plate lying in a plane, wherein the plurality of liquid passages into said chamber and the plurality of liquid passages out of said chamber are positioned relative to each other such that liquid moves into and out of said chamber in a plane parallel to the plane of said nozzle plate.

17. A drop on demand ink jet print head as defined in claim 15, the nozzle plate lying in a plane, wherein the plurality of liquid passages into said chamber and the plurality of liquid passages out of said chamber are positioned relative to each other such that liquid moves into and out of said chamber in a plane perpendicular to the plane of said nozzle plate.

18. A drop on demand ink jet print head as defined in claim 15, wherein the plurality of liquid passages into said chamber are positioned opposed relative to each other such that opposing liquid flows are provided into said chamber.

19. A drop on demand ink jet print head as defined in claim 18, the nozzle plate lying in a plane, wherein the plurality of liquid passages into said chamber are positioned relative to each other such that liquid moves into said chamber in a plane parallel to the plane of said nozzle plate.

20. A drop on demand ink jet print head as defined in claim 15, wherein the plurality of liquid passages out of said chamber are positioned opposed relative to each other such that opposing liquid flows are provided out of said chamber.

21. A drop on demand ink jet print head as defined in claim 15, wherein the actuator is associated with said chamber, the plurality of liquid passages out of said chamber, and combinations thereof.

* * * * *